United States Patent [19]

Scholler

[11] Patent Number: 4,722,164

[45] Date of Patent: Feb. 2, 1988

[54] NON-LINEAR STAIR

[76] Inventor: Siegfried Scholler, 1726-5th Ave., N. Regina, Saskatchewan, Canada, S4R 0R5

[21] Appl. No.: 855,469

[22] Filed: Apr. 24, 1986

[51] Int. Cl.[4] ..... E04F 11/00

[52] U.S. Cl. ..... 52/741; 52/187; 52/191

[58] Field of Search ..... 52/182, 187, 191, 309.1, 52/188, 376, 811, 631, 741, 746

[56] References Cited

U.S. PATENT DOCUMENTS

| | | | |
|---|---|---|---|
| 485,449 | 11/1892 | Borneman et al. | 52/187 |
| 2,021,457 | 11/1935 | MacKenzie | 52/191 |
| 3,909,997 | 10/1975 | Eickhof | 52/191 X |

FOREIGN PATENT DOCUMENTS

| | | | |
|---|---|---|---|
| 997916 | 10/1976 | Canada | 52/187 |
| 1659451 | 11/1969 | Fed. Rep. of Germany | 52/187 |
| 617432 | 2/1949 | United Kingdom | 52/187 |
| 1214644 | 12/1969 | United Kingdom | 52/191 |

OTHER PUBLICATIONS

"Constructon Dictionary", Pierre Chabat, 1881, Paris, France.

*Primary Examiner*—Carl D. Friedman

*Attorney, Agent, or Firm*—Adrian D. Battison; Stanley G. Ade

[57] ABSTRACT

A modified construction for a non-linear or curved staircase employs a technique in which the treads for the staircase are initially cut to the required shape and size. Flexible plywood boards of the same length and height as the required stringers are then attached to the treads with the treads positioned in the required locations and orientations so as to create a rigid self-supporting structure formed by the flexible boards and the attached treads and risers where required. The self-supporting structure is then finished by the attachment to the flexible boards of suitable laminations. House of treads have the laminations applied to the outer surface of the boards. Exposed end treads have the laminations applied to the inner side of the boards.

13 Claims, 8 Drawing Figures

NON-LINEAR STAIR

BACKGROUND OF THE INVENTION

This invention relates to a non-linear stair, that is a stair having at least part thereof which is curved and thus extends from the bottom of the stair to a top of the stair over a non-linear path.

The major attraction about curved stairs of this type is that they are architecturally and visually very appealing and to achieve the maximum visual appeal it is preferable if they are custom designed to obtain a particularly unique shape. It will be appreciated, however, that stairs of this type require considerable amount of skill and long labour and accordingly are extremely expensive. Traditionally such curved or non-linear stairs are manufactured by the following steps:

(1) First the number of risers and their height has to be determined (usually 14 risers for standard 8' ceiling height).

(2) A drawing scale 1-1 has to be done showing all the treads, the stringers and risers. The number of treads to be one less than the number of risers.

(3) Then the treads are made by transferring the lines, angles and curves from the drawing onto an oversized piece of wood making the ends approximately ½" longer than the inside edge of the stringers so they can be mortised into the stringers. Also each tread has to be made wider at the front edge by a predetermined size so that every consecutive tread overhangs the previous one. This is called a nosing and allows for moulding or carpet to be wrapped around. Then the treads are grooved to house the top edge of the risers.

(4) Next the riser is made by marking the inside stringer line of both stringers at the front and back of each riser which will give the angle at which they have to be cut, the riser being a board equal in size to the rise previously determined plus depth of groove in the treads. Again the riser has to be cut ½" longer on each end to be mortised into the stringers.

(5) Next the stringers have to be laid out on the inside from which the stringers are to be laminated. Great care must be taken that all measurements correspond exactly with the drawing because these markings are used to mortise the stringers after they are laminated to house the treads and risers.

(6) Next a form has to be made for each stringer. This is usually done in the following manner:

Depending on the height of the stair, 4 or more horizontal frame members have to be made, usually from 1½" plywood. They also have to be made wide enough to hold their shape. These members have to be made to correspond with the inside line of the stringers less the size of the vertical members which will have to be mounted up on them at approximately 6" intervals, the members usually being 2×4 on the edge. Then all the vertical members have to be attached to the horizontal members. By now the form looks like part of a cage. Before this large form can be set up-right it has to be substantially braced to hold it square. When in upright position the form must be plumbed in al directions and braced securely because accuracy is important so the curvature and shape of the stringers match the treads and riser. To allow laminating the form must be able to support several hundred pounds of weight. Once the forms are set up and secured the upright members must be marked for the #1 riser ad read as well as the #13 tread and #14 riser also #7 tread should be marked to avoid sagging. Then the inside layers of the stringers which have previously been laid out are bent into the form making sure tread #1, #7 and #13 as well as risers #1 and #14 match up exactly. The inside stringer layer can be held in place with finishing nails. Then subsequent layers of plywood are glued and clamped on the top of each other until the desired thickness of stringer is reached. Then stringers are left in the forms for about 24 hours for curing before they can be processed further. After curing, the stringers are trimmed, that means the ends are cut to desired lengths and angles also the edges have to be trimmed flush and square. Next the stringers have to be mortised usually by using a router bearing in mind that the stringers are curved one concave and one convex. Special router guides have to be used and great skill is required. To finish of mortising the ends of the grooves have to be finished off by hand using a chisel and hammer to match the groove to the moulding at the front of the tread as well as back edge where the tread and the riser meet. All the work performed on the stringers is time consuming because they are shaped like a corkscrew and it is difficult to hold them down and they constantly have to be reclamped.

(7) After the stringers are completed the stairs can be assembled by starting with riser and tread #1, inserting them into the grooves or cut outs of the stringers and insert every other consecutive riser and tread in the same manner. The treads and risers are affixed to the stringers by various means such as glue and nails, screws, bolts, dowels or wedges.

The above procedure applies to both the housed stringer as well as the open stringer type. Stringers for open end stairs are not mortised, they have to be cut out for the treads to lay on which is very tedious and time consuming because accuracy is important to assure all the treads and risers fit well. Because of the curvature of the stringers, machines cannot be used.

It will be appreciated, therefore, that much of the labour involved in the manufacture of stairs by the conventional technique is involved in manufacturing the framework necessary for forming the stringers and for supporting the stringers and the treads during their assembly. This is therefore a highly inefficient manufacturing technique and significantly increases the cost of such custom built stairs.

The frame needs to be custom built for each different size and shape of stair and when large numbers of different sizes and shapes are to be built, the frame cannot be maintained and stored for future use as the number of different frames is of course very large.

Some manufacturers overcome this difficulty by limiting the stairs which they manufacture to a number of specific shapes and dimensions and in this way they are able to manufacture curved stairs more economically. However they are unable to build different shapes and dimensions of stairs according to the requirements of a particular customer and this leaves a significant market for custom built stairs which is totally unfulfilled.

It is one object of the present invention, therefore, to provide an improved method of manufacturing a non-linear stair which enables the manufacture of custom designed stairs without the necessity for a supporting frame arrangement.

SUMMARY OF THE INVENTION

According to the invention, therefore, there is provided a method of manufacturing a non-linear stair which follows from a bottom to a top of the stair a non-linear path of the type having two stringers which are shaped to follow the path and a plurality of treads which extend across between and are supported by the stringers, each of the stringers having a length so as to extend from the bottom to the top and a dimension transverse to its length very much less than the height of the stair from the bottom to the top, the method comprising the steps of forming a plurality of treads having a required shape to follow the path, forming a first and a second board each of which has a length to extend along a respective one of the stringers and a height substantially equal to the transverse dimension of the respective stringer, each of said boards being sufficiently flexible to bend into the shape of the respective stringer without fracturing, attaching the treads to each of the boards at required positions thereon for the treads and boards to follow the path, and subsequent to said attaching step laminating onto each of said boards further layers to build up to a required stringer thickness.

According to a second aspect of the invention, therefore there is provided a non-linear stair of the type which follows from a bottom to a top of the stair a non-linear path, the stair comprising two stringers which are shaped to follow the path and a plurality of treads which extend across between and are supported by the stringers, each of the stringers having a length so as to extend from the bottom to the top and a dimension transverse to its length very much less than the height of the stair from the bottom to the top said stringers formed respectively from a first and second board each of which has a length to extend along a respective one of the stringers and a height substantially equal to the transverse dimension of the respective stringer, each of said boards being sufficiently flexible to bend into the shape of the respective stringer without fracturing, said boards being attached to the treads at required positions thereon for the treads and boards to follow the path, and subsequent to said attachment having laminated thereon further layers to build up to a required stringer thickness.

The non-linear stair can therefore be manufactured by a technique in which the stringers are formed by lamination while in situ attached to the treads. This technique is a unique departure from the conventional technique and enables the stringers to be shaped basically by their attachment to the treads so that the formation of the treads and the initial boards forming the stringers can be shaped to form the correct shape of stair without necessity for a supporting framework. Such an arrangement of the initial flexible boards and the treads is effectively self-supporting and can in fact be used to support the persons and machines required for the further techniques required in the lamination and cutting.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
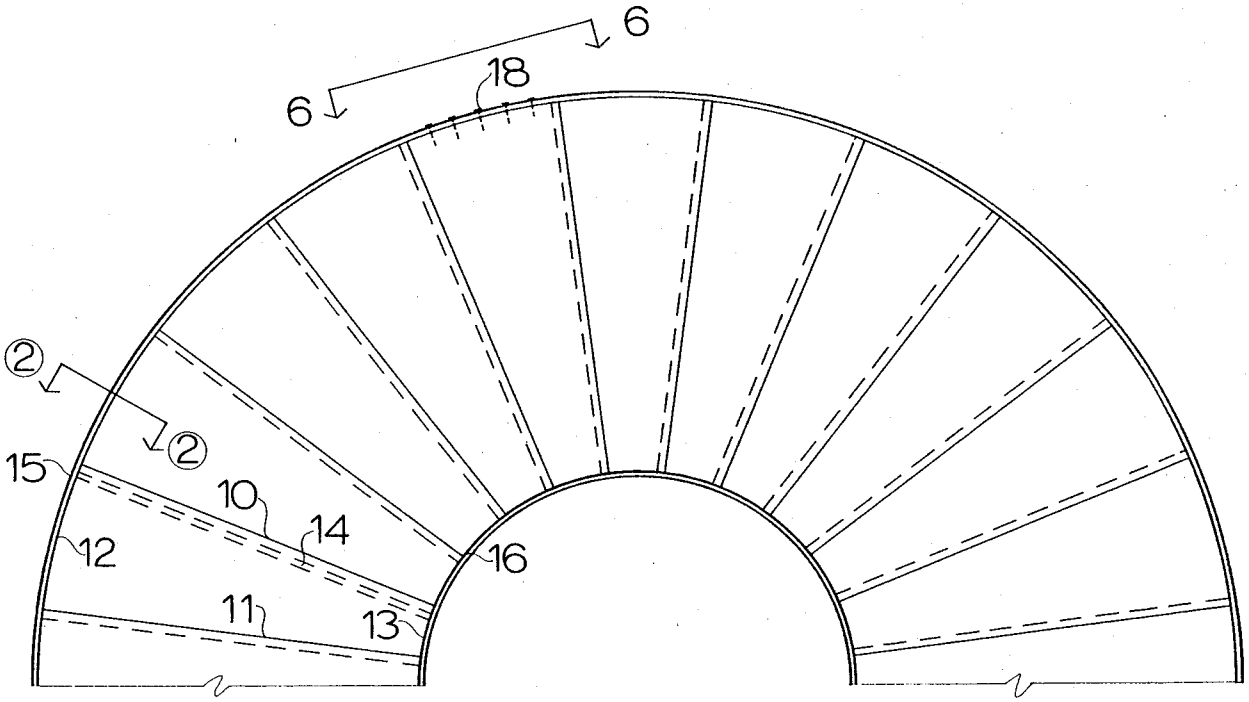
FIG. 1 is a typical plan view of a circular staircase according to the invention in partially constructed condition.
Figure 2:
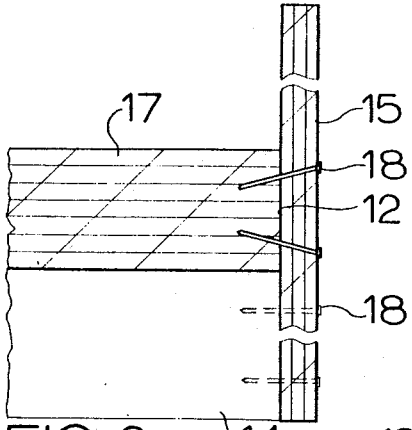
FIG. 2 is a cross sectional view along the lines 2—2 of FIG. 1.
Figure 6:
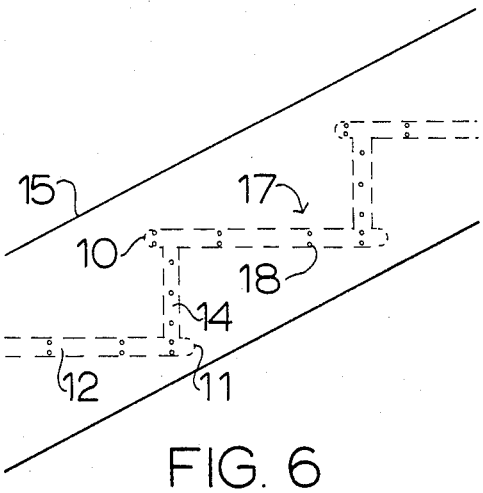
FIG. 6 is a view along the lines 6—6 of FIG. 1.

The initial stage of construction of a stair according to the invention is shown in FIGS. 1, 2 and 6. In this initial stage, a number of treads have already been cut to size from a drawing to full size of the intended shape of the staircase. The treads are of the required shape to complete the staircase that is the front edge and rear edge indicated at 10 and 11 for a respective one of the treads are cut to the required non-parallel angle to follow the desired curvature of the stair. Outer and inner edges 12 and 13 respectively are also cut to the desired curvature of the stringer. The tread is cut to the exact required size of the tread without any additional lengths for mortising since the stringer is attached directly to the end of the tread as will be explained hereinafter. The risers are indicated generally at 14 and are of conventional construction although again they are cut to the exact required length without any additional portions for mortising.

Thus in the initial condition shown in FIG. 1 the treads have already been cut to the required size in accordance with the drawing. In the example of FIG. 1 all of the treads are basically the same shape since the stair follows a constant curvature but it will of course be appreciated that the treads can vary in shape depending upon varying curvatures along the length of the stair if so required for a particular construction.

With the treads thus complete, two elongate boards 15 and 16 are cut to length and to height. The length of the board 15 is as clearly shown significantly longer than the board 16 in view of the fact that it extends around the outside curvature of the stair with the board 16 extending around the inside curvature. The height of the boards is approximately equal to the desired height of the stringer in the intended finished stair. The length of the boards is, as far as possible, the full length of the required stringer although in some cases the outer board 15 can be formed of two or more pieces joined end to end.

In the first phase of the construction, therefore, the boards forming the initial portions of the stringers are attached to the treads with the treads arranged on the boards at the required angle to achieve the required arrangement of the board to define the stringer. Thus as shown in FIG. 6 the angle and position of the tread generally indicated at 17 is initially marked on the board 15 and then the board moved to the required angle to the ground so that the tread is positioned relative to the board in the required horizontal orientation following which the board is attached to the tread by nails 18 which are driven through the board into the end face of the tread. The number of nails can be varied in accordance with the requirements but is sufficient to ensure that the board is pulled tight against the end of the tread and properly follows the curvature of the tread without any gaps or inaccuracies.

It will be appreciated therefore that the boards 15 and 16 are formed of a suitable flexible plywood material which may be for example ¼ inch thick and of 3-ply construction. Such a material is readily able to bend to the suitable curvatures for example the curvature of the inner board 16 without fracturing and after curvature can closely follow the end faces of the treads as required.

After the completion of the initial construction as shown completed in FIG. 1, all of the treads and risers are attached by the suitable nails to the boards so that the whole construction stands in the desired finished shape of the stair with of course the necessity for some support of the upper end only of the boards and uppermost tread to retain the treads horizontal. It has been found that the plywood board stated above has sufficient strength to support the whole structure in self-supporting arrangement and even to carry the necessary weight of workman and tools for further working on the stair. In many cases this strength is provided from the fact that the forces from the weight on the person are transmitted through the treads and risers to the ground rather than directly through the boards.

Turning now to FIG. 2 it will be noted that the tread 17 can itself be formed from a laminate as shown. In addition it will be noted that the nails 18 directed through the board 15 into the end of the tread are directed from a position at the upper and lower edges respectively of the tread toward the center of the tread to provide additional forces holding the board 15 into close contact with the outer edge 12 of the tread.

Figure 3:
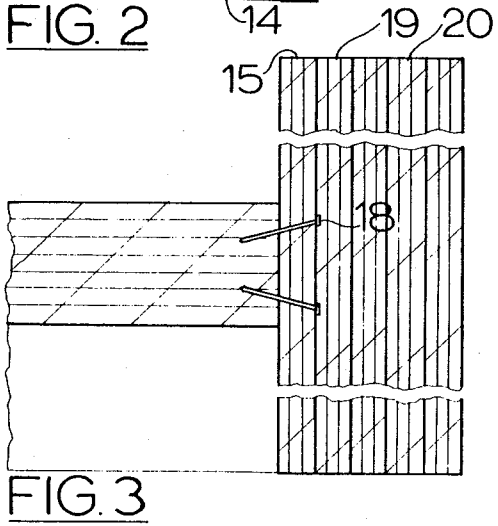
FIG. 3 is a cross sectional view similar to that of FIG. 2 showing the stair in a next step of the manufacturing process.

Turning now to FIG. 3, with the construction in the assembled form of FIG. 1, further layers 19, 20, etc. are laminated onto the outer face of the board 15 to form the required thickness of the finished stringer. It will be appreciated that the boards are basically the same construction as the plywood board 15 and each is curved to follow the outer surface of the board 15 and then is laminate thereto by gluing and clamping technique which is conventional in the trade. The number of boards applied in lamination in this way is of course dependent upon the required thickness of the stringer as will be apparent to one skilled in the art.

Figure 4:
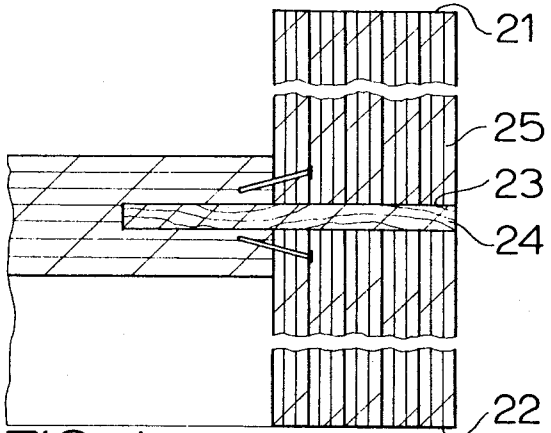
FIG. 4 is a yet further cross sectional view showing a further step of the manufacturing process.

Turning now to FIG. 4, the next step in construction is shown in which the laminated boards 15, 19, 20 are cut at upper and lower edges 21, 22 to form a required finished stringer surface. In addition a pair of holes 23 is drilled through the boards 15, 19, 20 into the end face 12 of the respective tread. Each of these holes is filled with a dowel 24 which is arranged to terminate at the surface of the outermost board indicated at 25 and to extend into the interior of the tread to provide additional coupling forces between the tread and the stringer. The dowel is generally glued into position to ensure a permanent attachment to both of the required portions.

Figure 5:
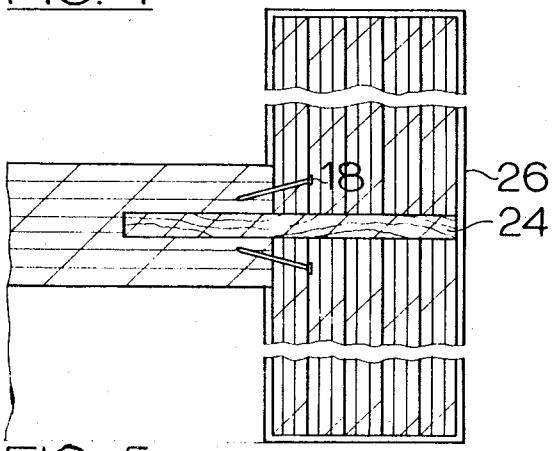
FIG. 5 is a yet further cross sectional view showing the staircase in completed condition.

Finally in FIG. 5 a finishing laminate 26 is applied on the outer face of the outermost board 25 thus covering the dowels 24 and providing an outer pleasing finished appearance for the stringer.

Thus the stair is completed with the stringers following exactly the required shape and with the treads firmly attached to the stringers without the necessity for any supporting structure or framework defining the shape of the stringers. In other words the stringers are themselves shaped by following the required positioning of the treads following which the shaped stringers are built up by lamination to the required thickness and finished by a final laminate layer.

Hand rails for the staircase can be formed by following again a lamination technique using the finished stringers to support an initial curvature of a first board following which further boards are laminated to the first board following the required curvature as defined by the respective stringer, the outermost boards of the handrail defining a required handrail cross section in conventional manner.

Figure 7:
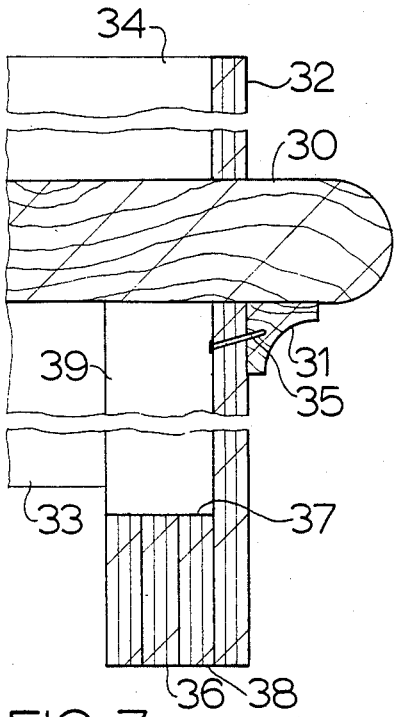
FIG. 7 is a cross sectional view similar to FIG. 2 showing a completed construction of a stair having open ended treads and including a riser.

Turning now to FIG. 7, a completed stair is shown in part cross section showing the technique for manufacture of an open end tread construction according to the invention. Thus an open end tread is indicated at 30 which carries on an underside a bead 31. An initial board for attachment to the tread is indicated at 32. Thus the initial construction of the stair is carried out according to the previous description in which the treads are cut to size and shape and including risers 33, 34. The initial board forming the outer stringer indicated at 32 is then cut to the required length and height. It is then cut again to define the required upper edge shape to receive the treads lying on the upper edge in conventional manner. The cut board is then screwed to the treads by wood screws 35 so as again to form a rigid construction with the initial stringer formed by the flexible board 32. In this case the wood screws are applied from the inner surface of the board 32 outwardly into the bead 31 and into the tread itself indicated at 30. Therefore again a construction similar to that of FIG. 1 is complete with the two stringers on either sides of the treads formed simply by the flexible boards 32.

In this case, however, lamination onto the board 32 is carried out using additional layers 36 only at the lowermost edge of the board 32 so as to define a strip having an upper edge 37 and a lower edge 38. This laminate at the lowermost edge provides strength to the board 32 and provides the visible surface of the stair beneath the treads. Between the treads and this lower strip and between the treads and the risers and the lower strip, the area is filled in by a suitable filler material indicated at 39 which may be a fibreglass reinforced resin material. This completes the strength of the stringer and fills in the stringer with material of a reduced expense and with less labour involved thus reducing the cost of the finished staircase. In addition, it will be appreciated that the lamination technique by which the layers 36 are applied to the board 32 requires that the layers 36 are clamped to the board 32 and this cannot be achieved when the only access to the layers 36 is from the lower edge of the board 32. It will be appreciated that the upper edge is covered by the risers 33, 34 and by the tread 30.

Figure 8:
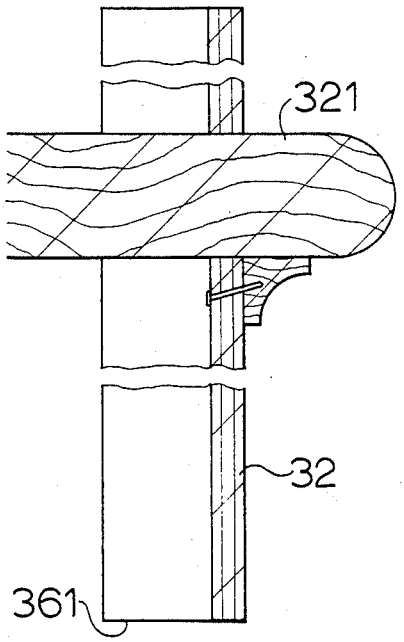
FIG. 8 is a view similar to that of FIG. 7 showing a further construction of stair including open ended treads and no riser.

FIG. 8 shows a similar construction to that of FIG. 7 except that the stair construction is one using open end boards 321 without the use of risers 33 or 34. In this case, therefore, the outermost board 32 which is attached to the tread in the same manner as that shown in FIG. 7 can be laminated on the whole of its inner surface by additional boards 361 since the clamping of the boards to the outermost board 32 in the lamination process can be achieved from the top and from the bottom to provide a proper lamination effect.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of manufacturing a stair which follows from a bottom to a top of the stair a non-linear path of the type having two stringers which are shaped to follow the path and a plurality of treads which extend across between and are supported by the stringers, each of the stringers having a length so as to extend from the bottom to the top and a dimension transverse to its length very much less than the height of the stair from the bottom to the top, the method comprising the steps of forming a plurality of treads having a required shape to follow the path, forming the two stringers by forming a first and a second board from sheet material having a planar shape each of which boards has a length to extend along a respective path of one of the stringers and a height substantially equal to the transverse dimension of the respective stringer, each of said boards being sufficiently flexible to bend from the planar shape into the shape of the respective stringer without fracturing, temporarily bending the boards by distorting them from the planar shape, while temporarily distorted attaching each of the boards alone to each of the treads at required positions thereon for the treads and boards to follow the path so that the boards are permanently maintained distorted from the planar shape by their attachment to the treads, and subsequent to said attaching step laminating onto each of said boards further layers to build up to a required stringer thickness.

2. The invention according to claim 1 wherein the boards are attached to the treads in such a way that the boards and treads prior to said laminating form a self-supporting structure.

3. The invention according to claim 1 wherein the stair is of the type in which end faces of the treads terminate inside an outermost surface of the respective stringer, the method comprising attaching each board to the adjacent end face of the tread to leave an exposed outer face of the board and laminating a plurality of board layers on the outer face of the board.

4. The invention according to claim 3 including the step of drilling a hole through the layers into the end face of each tread and inserting into the hole a dowel.

5. The invention according to claim 3 wherein the board is attached to the end face of each tread by nails applied through the outer face of the board into the end face of the tread.

6. The invention according to claim 1 wherein the stair is of the type in which end faces of the treads terminate outside an outermost surface of the respective stringer and each tread carries on an underside a pair of beads each adjacent a respective end of the tread, the method comprising attaching an outer face of each board to an inwardly facing surface of a respective one of the beads and laminating on an inner face of the board a plurality of board layers.

7. The invention according to claim 6 wherein the stair is of the type including a riser and wherein the stringer terminates beneath the respective tread and rearwardly of the respective riser, the method comprising laminating said inner face of the board only on a portion of the board at a lower edge of the board and coating an area between said laminated portion and the tread with a reinforced resin material.

8. A method of manufacturing a stair which follows from a bottom to a top of the stair a non-linear path of the type having at least one stringer which is shaped to follow the path and a plurality of treads which extend from and are supported by the stringer, the stringer having a length so as to extend from the bottom to the top and a dimension transverse to its length very much less than the height of the stair from the bottom to the top, the method comprising the steps of forming a plurality of treads having a required shape to follow the path, forming the stringer by forming a board from sheet material having a planar shape which board has a length to extend along the path of the stringer and a height substantially equal to the transverse dimension of the stringer, said board being sufficiently flexible to bend from the planar shape into the shape of the stringer without fracturing, temporarily bending the board by distorting it from the planar shape, while temporarily distorted attaching the board alone to each of the treads at required positions thereon for the treads and board to follow the path so that the board is permanently maintained distorted from the planar shape by its attachment to the treads, and subsequent to said attaching step laminating onto said board further layers to build up to a required stringer thickness.

9. The invention according to claim 8 wherein the stair is of the type in which end faces of the treads terminate inside an outermost surface of the stringer, the method comprising attaching the board to the adjacent end face of the tread to leave an exposed outer face of the board and laminating a plurality of board layers on the outer face of the board.

10. The invention according to claim 9 including the step of drilling a hole through the layers into the end face of each tread and inserting into the hole a dowel.

11. The invention according to claim 9 wherein the board is attached to the end face of each tread by nails applied through the outer face of the board into the end face of the tread.

12. The invention according to claim 8 wherein the stair is of the type in which end faces of the treads terminate outside an outermost surface of the stringer and each tread carries on an underside a pair of beads each adjacent one end of the tread, the method comprising attaching an outer face of the board to an inwardly facing surface of the bead and laminating on an inner face of the board a plurality of board layers.

13. The invention according to claim 12 wherein the stair is of the type including a riser and wherein the stringer terminates beneath the respective tread and rearwardly of the respective riser, the method comprising laminating said inner face of the board only on a portion of the board at a lower edge of the board and coating an area between said laminated portion and the tread with a reinforced resin material.

* * * * *